US009709011B2

(12) United States Patent
Tanada et al.

(10) Patent No.: US 9,709,011 B2
(45) Date of Patent: Jul. 18, 2017

(54) FUEL INJECTION VALVE

(71) Applicant: DENSO CORPORATION, Kariya, Aichi (JP)

(72) Inventors: Hiroki Tanada, Kariya (JP); Daiji Ueda, Kariya (JP); Motoya Kanbara, Nishio (JP)

(73) Assignee: DENSO CORPORATION, Kariya (JP)

( * ) Notice: Subject to any disclaimer, the term of this patent is extended or adjusted under 35 U.S.C. 154(b) by 18 days.

(21) Appl. No.: 14/859,399

(22) Filed: Sep. 21, 2015

(65) Prior Publication Data

US 2016/0115927 A1 Apr. 28, 2016

(30) Foreign Application Priority Data

Oct. 28, 2014 (JP) ..... 2014-219293

(51) Int. Cl.
*F02M 63/00* (2006.01)
*F02M 47/02* (2006.01)

(52) U.S. Cl.
CPC ..... *F02M 63/0026* (2013.01); *F02M 47/027* (2013.01); *F02M 63/0028* (2013.01)

(58) Field of Classification Search
CPC ..... F02M 47/027; F02M 63/0026; F02M 63/0028; F02M 63/0029; F02M 63/0003; F02M 63/0005; F02M 63/005; F02M 63/04; F02M 2200/304
USPC ..... 239/584, 533.1–533.15, 88–92
See application file for complete search history.

(56) References Cited

U.S. PATENT DOCUMENTS

| | | | | |
|---|---|---|---|---|
| 6,725,841 | B1 * | 4/2004 | Boecking | F02M 45/04 123/467 |
| 7,621,258 | B2 * | 11/2009 | Heinz | F02M 47/027 123/467 |
| 2003/0056757 | A1 * | 3/2003 | Tian | F02M 47/027 123/446 |
| 2006/0016906 | A1 | 1/2006 | Matsumoto | |
| 2010/0301143 | A1 | 12/2010 | Adachi et al. | |
| 2011/0088660 | A1 * | 4/2011 | Gruenberger | F02M 47/027 123/445 |
| 2013/0214057 | A1 * | 8/2013 | Doehring | F01N 3/206 239/68 |

* cited by examiner

*Primary Examiner* — Arthur O Hall
*Assistant Examiner* — Juan C Barrera

(57) ABSTRACT

A high-pressure-side valve portion makes contact with and moves from a high-pressure seat surface formed in a body to control communication between a control chamber communication passage and a high-pressure passage. A low-pressure-side valve portion makes contact with and moves from a low-pressure seat surface formed in the body to control communication between an exhaust passage and a second intermediate chamber. A releasing portion in the high-pressure-side valve portion communicates with the control chamber communication passage when the high-pressure seat surface is in contact with the high-pressure-side valve portion to block the control chamber communication passage from the high-pressure passage. A valve element internal passage is formed in the valve element to communicate the releasing portion with the second intermediate chamber.

8 Claims, 5 Drawing Sheets

FUEL INJECTION VALVE

CROSS REFERENCE TO RELATED APPLICATION

This application is based on reference Japanese Patent Application No. 2014-219293 filed on Oct. 28, 2014, the disclosure of which is incorporated herein by reference.

TECHNICAL FIELD

The present disclosure relates to a fuel injection valve for injecting fuel into an internal combustion engine.

BACKGROUND

For example, Patent Document 1 discloses a conventional fuel injection valve. In the fuel injection valve disclosed in Patent Document 1, a nozzle needle is biased in a closing direction with fuel pressure in a control chamber. The fuel injection valve is configured to control pressure in the control chamber to control a valve operation of the nozzle needle.

More specifically, a control chamber communication passage is formed to communicate with the control chamber regularly. In addition, fuel is discharged from the control chamber through the control chamber communication passage and an exhaust passage to a low-pressure portion thereby to reduce fuel pressure in the control chamber. In this way, the nozzle needle is moved in the opening direction. To the contrary, high-pressure fuel is drawn from a high-pressure passage through the control chamber communication passage into the control chamber thereby to increase fuel pressure in the control chamber. In this way, the nozzle needle is moved in the closing direction.

A valve element is located in a valve chamber to control communication between the control chamber communication passage and the exhaust passage and to control communication between the control chamber communication passage and the high-pressure passage. The valve element is biased with a valve element spring in a direction to block the control chamber communication passage from the exhaust passage. In addition, the valve element is actuated with an actuator, which uses a piezoelectric element, in a direction to block the control chamber communication passage from the high-pressure passage.

It is noted that, a needle closing speed may be desirably set at a high speed in order to retain an accuracy of a quantity of fuel injection. It is further noted that, the needle closing speed may be set at a high speed by enlarging a passage area of a throttle formed in the high-pressure passage.

However, in a state where the control chamber communication passage is blocked from the high-pressure passage, namely, in the needle closing state, pressure of high-pressure fuel produces a force applied to the valve element in a direction to communicate the control chamber communication passage with the high-pressure passage. Therefore, in a case where the passage area of the throttle of the high-pressure passage is enlarged, an area of the valve element, which receives pressure of high-pressure fuel, becomes large in a state where the control chamber communication passage is blocked from the high-pressure passage. Consequently, this configuration may require the actuator to produce a large actuating force to cause the valve element to retain the state where the control chamber communication passage is blocked from the high-pressure passage. Thus, this configuration may enlarge the actuator.

In consideration of this, the fuel injection valve disclosed in Patent Document 1 is configured to utilize pressure in the valve chamber and the control chamber as an assist pressure when the valve element blocks the control chamber communication passage from the high-pressure passage. In this way, this configuration may reduce actuating force required to the actuator. This configuration may enable to avoid enlargement of the actuator and may increase the needle closing speed.

(Patent Document 1)

Publication of unexamined Japanese patent application No. 2006-46323

It is further noted that, it is assumable that a common rail pressure, which is pressure of high-pressure fuel, becomes greater than a present pressure to improve a combustion performance and/or the like. It is further assumable that a passage area of the throttle of the high-pressure passage is further enlarged. Consequently, in those cases, an actuating force required to the actuator may become greater than a present actuating force. Thus, enlargement of an actuator may be unavoidable.

SUMMARY

It is an object of the present disclosure to produce a fuel injection valve enabling to reduce an actuating force required to an actuator to retain a valve element to block a control chamber communication passage from a high-pressure passage in a configuration where the nozzle needle is biased in a closing direction with fuel pressure in a control chamber.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

A first embodiment of the present disclosure will be described.

A fuel injection valve of the present embodiment is configured to receive high-pressure fuel from a common rail (not shown) and to inject the high-pressure fuel into a combustion chamber of a compression-ignition type internal combustion engine (not shown).

Figure 1:
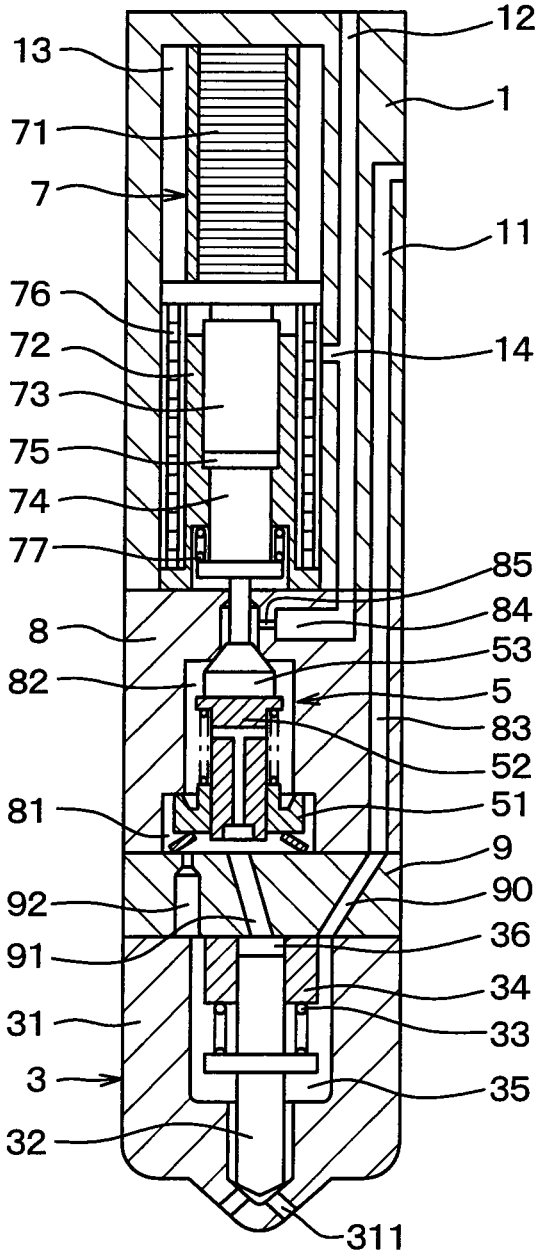
FIG. 1 is a sectional view showing a configuration of a fuel injection valve according to a first embodiment of the present disclosure.
Figure 2:
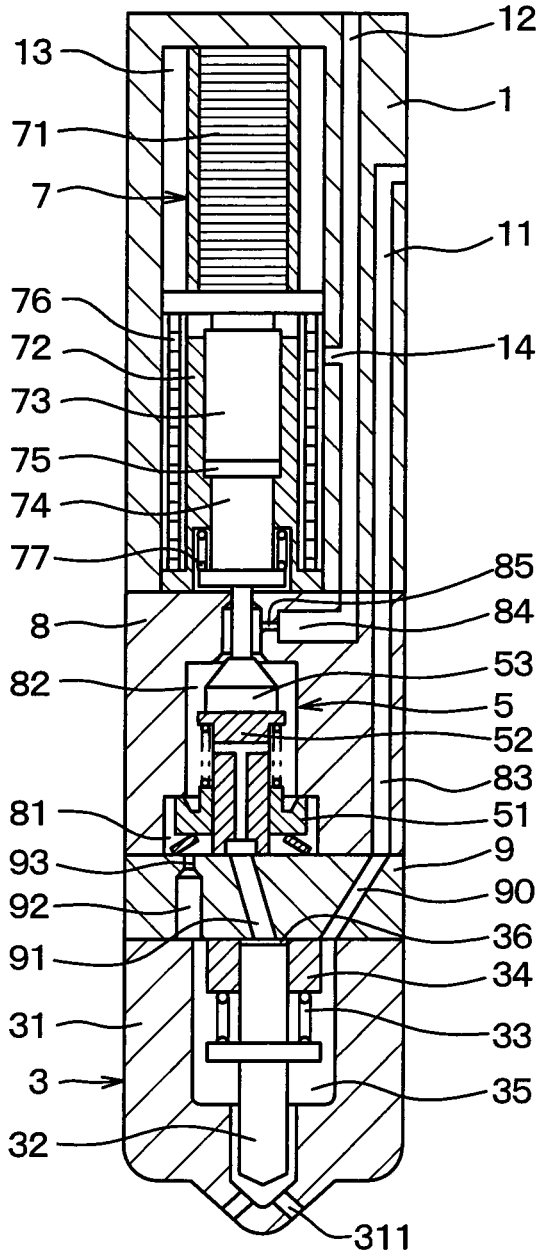
FIG. 2 is a sectional view showing another operating state of the fuel injection valve according to the first embodiment of the present disclosure.
Figure 3:
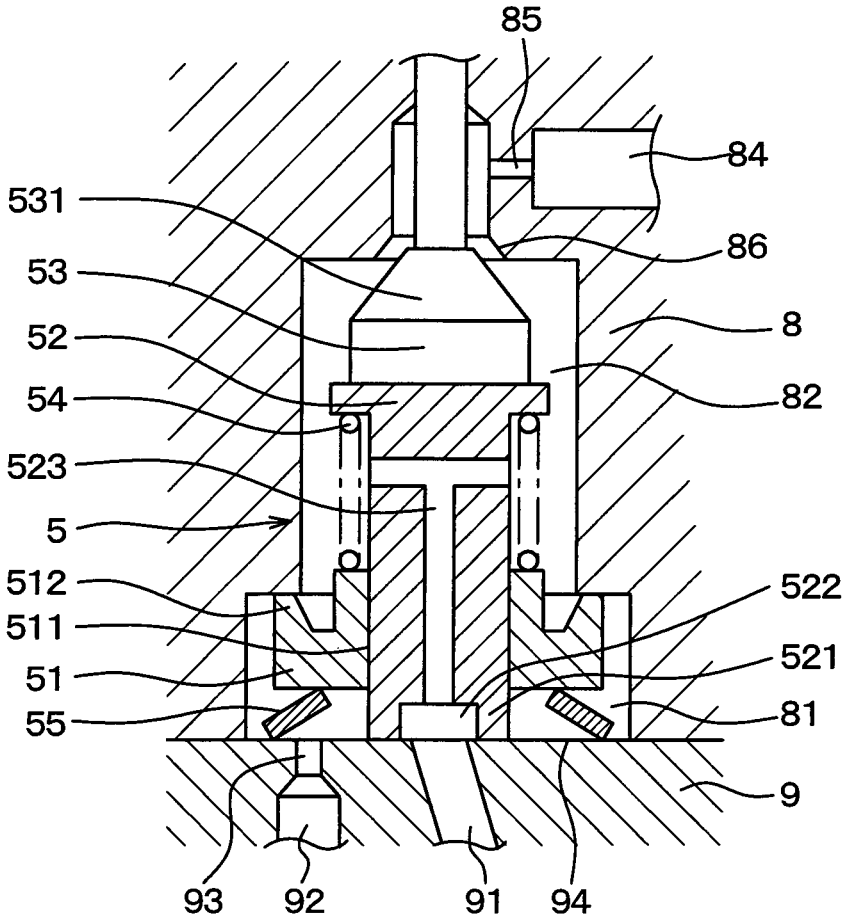
FIG. 3 is an enlarged sectional view showing peripheral components of a control valve mechanism of FIG. 1.

As shown in FIGS. 1 to 3, the fuel injection valve includes, as main components, an injector body 1, a nozzle 3, a control valve mechanism 5, an actuator 7, a first intermediate body 8, a second intermediate body 9, and/or the like.

The injector body 1 is substantially in a bottomed tubular shape. The injector body 1 has a high-pressure fuel passage 11, a low-pressure fuel passage 12, and an accommodation chamber 13. The high-pressure fuel passage 11 conducts high-pressure fuel supplied from the common rail. The low-pressure fuel passage 12 is connected with a fuel tank (not shown) and is regularly set at low pressure. The accommodation chamber 13 accommodates the actuator 7. The accommodation chamber 13 is connected to the low-pressure fuel passage 12 through the low-pressure communication hole 14. The low-pressure fuel passage 12 may be equivalent to a low-pressure portion of the present disclosure.

The first intermediate body 8 is adjacent to the injector body 1. The first intermediate body 8 has a first intermediate chamber 81, a second intermediate chamber 82, and a high-pressure fuel passage 11. The first intermediate chamber 81 and the second intermediate chamber 82 accommodate the control valve mechanism 5. The high-pressure fuel passage 83 communicates with the high-pressure fuel passage 11. The second intermediate chamber 82 is connected to the low-pressure fuel passage 12 through the exhaust passage 84. The exhaust passage 84 has an exhaust throttle 85.

The first intermediate chamber 81 and the second intermediate chamber 82 are column shaped spaces, respectively. The first intermediate chamber 81 and the second intermediate chamber 82 are located in series along an axial direction of the injector body 1. More specifically, the first intermediate chamber 81 opens in an end surface of the first intermediate body 8 on the side of the second intermediate body 9. The second intermediate chamber 82 is located on the opposite side of the first intermediate chamber 81 from the second intermediate body 9. That is, the second intermediate chamber 82 is located closer to the injector body 1 than the first intermediate chamber 81.

The nozzle 3 includes a nozzle body 31, a nozzle needle 32, a nozzle spring 33, and a nozzle cylinder 34. The nozzle body 31 is substantially in a bottomed tubular shape. The nozzle needle 32 is substantially in a column shape and is inserted in the nozzle body 31. The nozzle needle 32 is slidable in the nozzle body 31. The nozzle spring 33 biases the nozzle needle 32 in a closing direction. The injector body 1, the first intermediate body 8, the second intermediate body 9, and the nozzle body 31 form a body in the present disclosure.

The nozzle body 31 has a nozzle hole 311, which is to inject high-pressure fuel into the combustion chamber of the internal combustion engine. A tip end (nozzle-hole-side end) of the nozzle needle 32 is seated on the nozzle body 31 and is lifted from the nozzle body 31 thereby to close and open the nozzle hole 311.

The nozzle body 31 internally forms a fuel accumulator chamber 35, which receives high-pressure fuel regularly from the common rail. The high-pressure fuel flows from the common rail through the fuel accumulator chamber 35 toward the nozzle hole 311.

The nozzle cylinder 34 is in a tubular shape. The nozzle cylinder 34 is biased with the nozzle spring 33 toward the second intermediate body 9. The rear end (counter-nozzle-hole-side end) of the nozzle needle 32 is inserted in the nozzle cylinder 34. The rear end of the nozzle needle 32 is slidable in the nozzle cylinder 34.

The nozzle cylinder 34 internally forms a control chamber 36 in which fuel pressure is switched between high pressure and low pressure. The nozzle needle 32 is biased with fuel pressure in the control chamber 36 in the closing direction. The nozzle needle 32 is further biased with fuel pressure in the fuel accumulator chamber 35 in the opening direction.

The second intermediate body 9 is located between the first intermediate body 8 and the nozzle body 31. The second intermediate body 9 has a high-pressure fuel passage 90, a control chamber communication passage 91, and a high-pressure passage 92. The high-pressure fuel passage 90 connects the high-pressure fuel passage 83 with the fuel accumulator chamber 35. The control chamber communication passage 91 communicates the first intermediate chamber 81 with the control chamber 36. The high-pressure passage 92 communicates the first intermediate chamber 81 with the fuel accumulator chamber 35. The high-pressure passage 92 has an opening end on the side of the first intermediate chamber 81, and the opening end forms an inflow throttle 93.

The control valve mechanism 5 includes a valve cylinder 51, a first valve element 52, a second valve element 53, a valve element spring 54, and a cylinder holding spring 55. The control valve mechanism 5 is accommodated in the first intermediate chamber 81 and the second intermediate chamber 82, which are formed in the first intermediate body 8.

The valve cylinder 51 is in a tubular shape. The valve cylinder 51 partitions the first intermediate chamber 81 from the second intermediate chamber 82. More specifically, the first intermediate chamber 81 is defined by the valve cylinder 51, the first intermediate body 8, and the second intermediate body 9. The second intermediate chamber 82 is defined by the valve cylinder 51 and the first intermediate body 8.

The valve cylinder 51 has a center portion in a radial direction, and the center portion has a cylinder hole 511 in which the first valve element 52 is inserted. The first valve element 52 is slidable in the cylinder hole 511.

The valve cylinder 51 has an end surface on the opposite side of the second intermediate body 9, and an outer circumferential periphery of the end surface has a cylinder protrusion 512 (FIG. 3) in an annular shape. The cylinder holding spring 55 is located between the valve cylinder 51 and the second intermediate body 9. The cylinder holding spring 55 and pressure of high-pressure fuel in the first intermediate chamber 81 biases the tip end of the cylinder protrusion 512 onto the first intermediate body 8. In this way, the tip end of the cylinder protrusion 512 and the first intermediate body 8 seal the first intermediate chamber 81 from the second intermediate chamber 82. The cylinder holding spring 55 may be, for example, a dish spring.

The first valve element 52 is substantially in a cylindrical shape. An intermediate portion of the first valve element 52 is inserted in the cylinder hole 511 and is slidable in the cylinder hole 511.

The first valve element 52 has an end surface on the side of the second intermediate body 9, and an outer circumferential periphery of the end surface forms a high-pressure-side valve portion 521. The high-pressure-side valve portion 521 is a protrusion in an annular shape. An inner circumferential periphery of the high-pressure-side valve portion 521 of the first valve element 52 forms a releasing portion 522 in a columnar shape.

The high-pressure-side valve portion 521 is seated on the high-pressure seat surface 94 of the second intermediate body 9 to block the control chamber communication passage 91 from the high-pressure passage 92. The high-pressure-side valve portion 521 is lifted from the high-pressure seat surface 94 to communicate the control chamber communication passage 91 with the high-pressure passage 92. More specifically, in a state where the high-pressure-side valve portion 521 makes contact with the high-pressure seat surface 94 to block the control chamber communication passage 91 from the high-pressure passage 92, the control chamber communication passage 91 communicates with the releasing portion 522. In addition, the high-pressure passage 92 does not communicate with the releasing portion 522.

The first valve element 52 internally forms a valve element internal passage 523, which communicates the releasing portion 522 with the second intermediate chamber 82.

The second valve element 53 is substantially in a cylindrical shape and is located in the second intermediate chamber 82. More specifically, the second valve element 53 is configured to be in contact with an end surface of the first valve element 52 on the opposite side of the second intermediate body 9. Thus, the second valve element 53 is configured to move integrally with the first valve element 52.

The second valve element 53 has an end on the opposite side of the second intermediate body 9, and the end forms a low-pressure-side valve portion 531. The low-pressure-side valve portion 531 is in a tapered shape or in a spherical shape. The low-pressure-side valve portion 531 is seated on the low-pressure seat surface 86 of the first intermediate body 8 to block the exhaust passage 84 from the second intermediate chamber 82. The low-pressure-side valve portion 531 is lifted from the low-pressure seat surface 86 to communicate the exhaust passage 84 with the second intermediate chamber 82. The first valve element 52 and the second valve element 53 may be equivalent to a valve element of the present disclosure.

The valve element spring 54 is interposed between the valve cylinder 51 and the first valve element 52. The valve element spring 54 biases both the first valve element 52 and the second valve element 53 in a predetermined direction. Specifically, the valve element spring 54 biases the first valve element 52 and the second valve element 53 in a direction to communicate the control chamber communication passage 91 with the high-pressure passage 92 and to block the exhaust passage 84 from the second intermediate chamber 82.

In addition, a set load of the cylinder holding spring 55 is greater than a set load of the valve element spring 54. The present configuration retains a state where a tip end of the cylinder protrusion 512 is biased onto the first intermediate body 8.

The actuator 7 includes a piezoelectric element layered body 71 and a transmission unit. The piezoelectric element layered body 71 is formed by laminating a number of piezoelectric elements to be in a columnar shape. The piezoelectric element layered body 71 is configured to expand by accumulating an electric charge and to contract by releasing an electric charge. The transmission unit transmits the extension and contraction of the piezoelectric element lamination object 71 to the control valve mechanism 5.

Configuration of the transmission unit will be described as follows. A first piston 73 and a second piston 74 are inserted in an actuator cylinder 72 such that the first piston 73 and the second piston 74 are slidable in the actuator cylinder 72 and are light-tight relative to the actuator cylinder 72. The first piston 73 and the second piston 74 form a liquid chamber 75, which is filled with fuel.

The first piston 73 is biased by a first actuator spring 76 toward the piezoelectric element layered body 71. In the configuration, the first piston 73 is directly actuated by the piezoelectric element layered body 71. When the piezoelectric element layered body 71 is expanded, the first piston 73 is caused to increase pressure in the liquid chamber 75.

The second piston 74 is biased with a second actuator spring 77 toward the control valve mechanism 5. In addition, the second piston 74 is configured to be actuated by receiving pressure in the liquid chamber 75.

Specifically, when the piezoelectric element layered body 71 is extended, the second piston 74 is actuated by receiving pressure in the compressed liquid chamber 75 at high pressure. Thus, the second piston 74 actuates the first valve element 52 and the second valve element 53 toward the second intermediate body 9. In this way, the high-pressure-side valve portion 521 makes contact with the high-pressure seat surface 94 to block the control chamber communication passage 91 from the high-pressure passage 92. In addition, the low-pressure-side valve portion 531 moves away from the low-pressure seat surface 86 to communicate the exhaust passage 84 with the second intermediate chamber 82.

To the contrary, when the piezoelectric element layered body 71 is contracted, pressure in the liquid chamber 75 becomes low. In this state, the second piston 74 is pushed back from the valve element spring 54 toward the first piston 73 against the second actuator spring 77.

Subsequently, an operation of the fuel injection valve will be described. First, the nozzle hole 311 shown in FIG. 1 is closed to be in a needle closing state. In the needle closing state, an electric charge is charged in the piezoelectric element layered body 71. Thus, the piezoelectric element layered body 71 is expanded to actuate the first piston 73. Thus, the first piston 73 is caused to increase pressure in the liquid chamber 75. Pressure in the compressed liquid chamber 75 is increased to high pressure to actuate the second piston 74 toward the first valve element 52 and the second valve element 53.

Subsequently, as shown in FIGS. 2 and 3, the second piston 74 actuates the first valve element 52 and the second valve element 53. Thus, the high-pressure-side valve portion 521 makes contact with the high-pressure seat surface 94 thereby to block the control chamber communication passage 91 from the high-pressure passage 92. In addition, the low-pressure-side valve portion 531 moves away from the low-pressure seat surface 86 thereby to communicate the exhaust passage 84 with the second intermediate chamber 82.

Therefore, fuel in the control chamber 36 flows through the control chamber communication passage 91, the releasing portion 522, and the valve element internal passage 523 into the second intermediate chamber 82. The fuel further flows through the exhaust throttle 85, the exhaust passage 84, and the low-pressure fuel passage 12 to return into the fuel tank.

Consequently, pressure in the control chamber 36 decreases to reduce a force, which biases the nozzle needle 32 in a closing direction. Therefore, the nozzle needle 32 moves in an opening direction to be in a needle opening state. Thus, fuel is injected from the nozzle hole 311.

In the needle opening state, the first valve element 52 blocks the control chamber communication passage 91 from the high-pressure passage 92. Therefore, pressure in the control chamber 36 working on the releasing portion 522 biases the first valve element 52 in a direction to be away from the high-pressure seat surface 94. That is, the pressure in the control chamber 36 biases the first valve element 52 in a direction against the actuating force of the actuator 7.

It is noted that, in the needle opening state, pressure in the control chamber 36 is controlled at a low pressure less than pressure of high-pressure fuel. Therefore, force caused by pressure in the control chamber 36 to bias the first valve element 52 becomes small. That is, the force in a direction against the actuating force of the actuator 7 becomes small.

To the contrary, in the needle opening state shown in FIG. 2, when electric charge of the piezoelectric element layered body 71 is discharged, the piezoelectric element layered body 71 contracts. In response, the actuator spring 76 returns the first piston 73 toward the piezoelectric element layered body 71. Thus, pressure in the liquid chamber 75 decreases to cause the valve element spring 54 to return the first valve element 52, the second valve element 53, and the second piston 74 toward the first piston 73.

In this way, the high-pressure-side valve portion 521 moves away from the high-pressure seat surface 94 to communicate the control chamber communication passage 91 with the high-pressure passage 92. In addition, the low-pressure-side valve portion 531 makes contact with the low-pressure seat surface 86 to block the exhaust passage 84 from the second intermediate chamber 82.

Therefore, high-pressure fuel in the fuel accumulator chamber 35 flows through the high-pressure passage 92, the inflow throttle 93, the first intermediate chamber 81, and the control chamber communication passage 91 into the control chamber 36.

Consequently, pressure in the control chamber 36 increases, and force biasing the nozzle needle 32 in the closing direction becomes large. Therefore, the nozzle needle 32 moves in the closing direction to close the nozzle hole 311. Thus, the state moves to the needle closing state, and fuel injection is completed.

According to present embodiment, in the state where the first valve element 52 blocks the control chamber communication passage 91 from the high-pressure passage 92, pressure in the control chamber 36, which is controlled at a low pressure less than pressure of high-pressure fuel, is applied on the releasing portion 522. Therefore, force, which is caused by pressure in the control chamber 36 and applied to the releasing portion 522 to bias the first valve element 52 in the direction against the actuating force of the actuator 7, becomes small. Therefore, actuating force required to the actuator 7 becomes small, and consequently, the configuration may enable to downsize the actuator 7.

In addition, the present configuration may reduce the force, which is caused by the pressure in the control chamber 36 and applied to the releasing portion 522 to bias the first valve element 52. Therefore, enlargement of the actuator 7 may be avoidable even in a case where the common rail pressure is set greater than the pressure in the present state and/or in a case where the passage area of the inflow throttle 93 is further enlarged.

In addition, in the present configuration, the valve element is divided into the first valve element 52 and the second valve element 53. Therefore, when the low-pressure-side valve portion 531 of the second valve element 53 makes contact with the low-pressure seat surface 86 of the first intermediate body 8, the center of the low-pressure-side valve portion 531 and the center of the low-pressure seat surface 86 may be aligned with each other automatically. Therefore, the present configuration may produce a high sealing performance at a contact portion between the low-pressure-side valve portion 531 and the low-pressure seat surface 86.

In addition, the cylinder holding spring 55 and the pressure of high-pressure fuel in the first intermediate chamber 81 biases the cylinder protrusion 512 onto the first intermediate body 8. Therefore, the present configuration may produce a high sealing performance at the contact portion between the cylinder protrusion 512 and the first intermediate body 8.

Second Embodiment

As follows, a second embodiment of the present disclosure will be described. In the following description, difference from the first embodiment will be mainly described.

Figure 4:
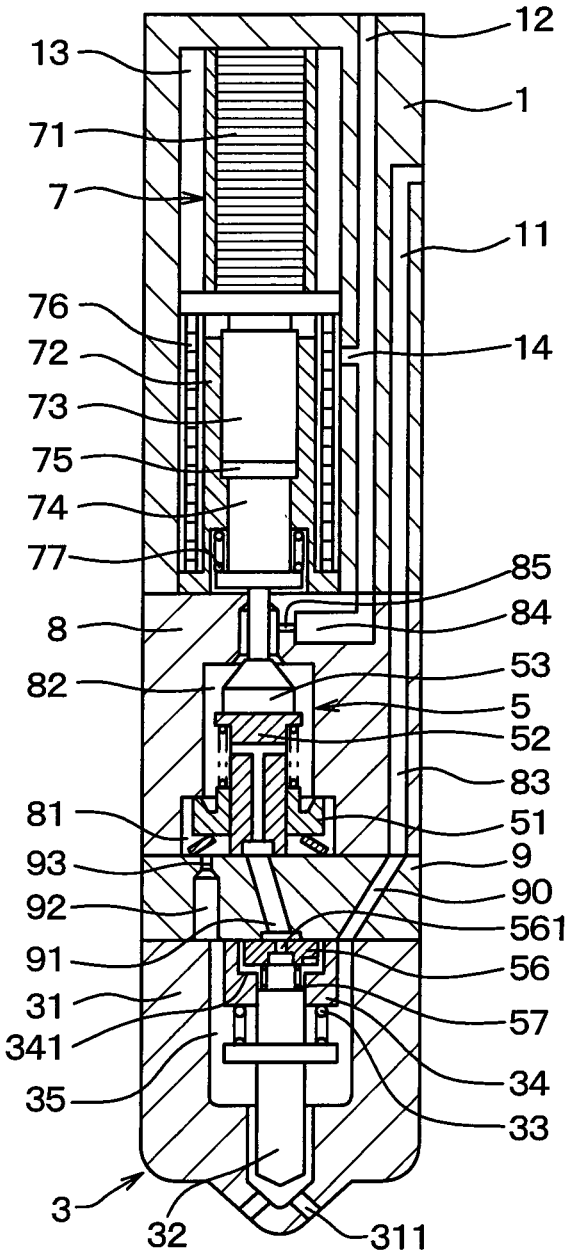
FIG. 4 is a sectional view showing a configuration of a fuel injection valve according to a second embodiment of the present disclosure.
Figure 5:
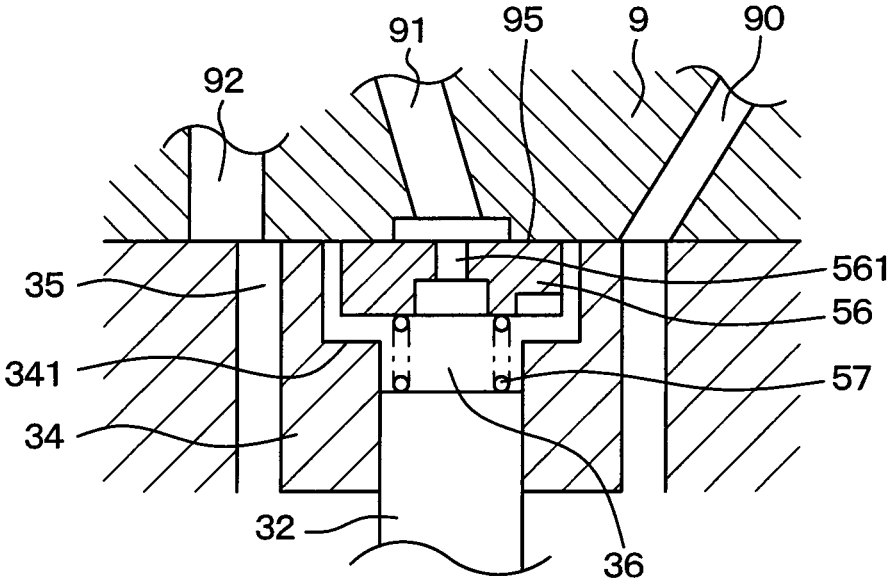
FIG. 5 is an enlarged sectional view showing peripheral components of a control plate of FIG. 4.

As shown in FIGS. 4 and 5, an inner wall surface of the nozzle cylinder 34 forms a stopper surface 341. In addition, a surface of the second intermediate body 9 on the side of the control chamber 36 forms a control chamber seat surface 95.

The control chamber 36 accommodates a control plate 56 and a plate spring 57. The control plate 56 is in a disc shape. The plate spring 57 biases the control plate 56 toward the control chamber seat surface 95. The control plate 56 is movable back and forth between the stopper surface 341 and the control chamber seat surface 95. The control plate 56 and the plate spring 57 form a part of the control valve mechanism 5.

The control plate 56 has a center portion in the radial direction, and the center portion has an exhaust throttle 561. The exhaust throttle 561 extends through the center portion of the control plate 56 in the axial direction of the control plate 56. In the state where the control plate 56 is in contact with the control chamber seat surface 95, the control chamber 36 communicates with the control chamber communication passage 91 through the exhaust throttle 561. In the present configuration, the exhaust throttle 561 is formed in the control plate 56, and therefore, the exhaust throttle 85 in the first embodiment is omitted from the exhaust passage 84.

In the state where the control plate 56 is in contact with the stopper surface 341, the control plate 56 divides the control chamber 36 into two spaces. Specifically, the control plate 56 divides the control chamber 36 into an intermediate body side control chamber, which is on the side of the second intermediate body 9, and a needle side control chamber, which is on the side of the nozzle needle 2. As follows, the terms of the control chamber 36, the intermediate body side control chamber, and the needle side control chamber are used separately as needed.

Subsequently, an operation of the fuel injection valve will be described. First, an electric charge is charged in the piezoelectric element layered body 71 in the needle closing state, in which the nozzle hole 311 is closed. Thus, similarly to the first embodiment, the high-pressure-side valve portion 521 makes contact with the high-pressure seat surface 94 to block the control chamber communication passage 91 from the high-pressure passage 92. In addition, the low-pressure-side valve portion 531 moves away from the low-pressure seat surface 86 to communicate the exhaust passage 84 with the second intermediate chamber 82.

When the exhaust passage 84 communicates with the second intermediate chamber 82, fuel in the control chamber 36 flows through the exhaust throttle 561, the control chamber communication passage 91, the releasing portion 522, and the valve element internal passage 523. Thus, the fuel flows into the second intermediate chamber 82. Furthermore, the fuel flows through the exhaust passage 84 and the low-pressure fuel passage 12 to return into the fuel tank.

Consequently, pressure in the control chamber 36 decreases to reduce a force, which biases the nozzle needle 32 in the closing direction. Therefore, the nozzle needle 32 moves in an opening direction to be in the needle opening state. Thus, fuel is injected from the nozzle hole 311.

To the contrary, an electric charge is discharged from the piezoelectric element layered body 71 in the needle opening state shown in FIG. 4. Thus, similarly to the first embodiment, the high-pressure-side valve portion 521 moves away from the high-pressure seat surface 94 to communicate the control chamber communication passage 91 with the high-pressure passage 92. In addition, the low-pressure-side valve portion 531 makes contact with the low-pressure seat surface 86 to block the exhaust passage 84 from the second intermediate chamber 82.

In this way, the control chamber communication passage 91 communicates with the high-pressure passage 92. Therefore, high-pressure fuel in the fuel accumulator chamber 35 flows through the high-pressure passage 92, the inflow throttle 93, and the first intermediate chamber 81 into the control chamber communication passage 91.

The control plate 56 is biased with pressure of fuel, which flows into the control chamber communication passage 91, to move in a direction away from the control chamber seat surface 95. Therefore, high-pressure fuel flows from the control chamber communication passage 91 into the intermediate body side control chamber. The high-pressure fuel passes through a clearance between an outer periphery of the control plate 56 and an inner wall surface of the nozzle cylinder 34. Thus, the high-pressure fuel flows into the needle side control chamber.

Consequently, pressure in the needle side control chamber increases, and force biasing the nozzle needle 32 in the closing direction becomes large. Therefore, the nozzle needle 32 moves in the closing direction to close the nozzle hole 311. Thus, the state moves to the needle closing state, and fuel injection is completed.

The present embodiment may produce an effect similarly to the first embodiment.

Other Embodiment

In the above embodiments, the actuator 7 is configured with the piezoelectric element layered body 71 and the transmission unit. It is noted that, the actuator 7 may be configured with a device to actuate the first valve element 52 and the second valve element 53 by utilizing an electromagnetic force.

In addition, the present disclosure is not limited to the above-described embodiments and may be arbitrarily modified.

The above-described embodiments are not necessarily irrelative to each other and may be combined with each other except for a case where combination of the embodiments is impossible.

In addition, an element exemplified in the embodiment(s) is not necessarily essential except for a case where an element is explicitly stated as essential and/or where an element is requisite to render an embodiment functional.

In addition, a numerical value such as a number of the component(s), a numerical value, a quantity, a range, and/or the like is not limited to those in the embodiment(s), except for a case where those are specified as requisite explicitly and/or except for a case where those are theoretically limited to a specific number.

In addition, the shape, the physical relationship, and/or the like of component(s) is not limited to those in embodiment(s) except for a case where those are theoretically limited to specific ones.

According to the present disclosure, the fuel injection valve includes the body, the nozzle needle, the control chamber, the first intermediate chamber, the second intermediate chamber, the valve cylinder, the valve element, the valve element spring, and the actuator. The body has the nozzle hole for injecting high-pressure fuel into the combustion chamber of the internal combustion engine. The nozzle needle is movable back and forth in the body to open and close the nozzle hole. The control chamber applies fuel pressure to the nozzle needle in the closing direction. The first intermediate chamber is communicated with the control chamber through the control chamber communication passage. The first intermediate chamber is supplied with high-pressure fuel through the high-pressure passage. The second intermediate chamber is communicated with the low-pressure portion through the exhaust passage. The valve cylinder partitions the first intermediate chamber from the second intermediate chamber. The valve element is inserted in the cylinder hole formed in the valve cylinder and is movable back and forth in the valve cylinder. The valve element is configured to communicate the control chamber communication passage with the high-pressure passage and to block the control chamber communication passage from the high-pressure passage. The valve element is configured to communicate the exhaust passage with the second intermediate chamber and to block the exhaust passage from the second intermediate chamber. The valve element spring biases the valve element in the direction to communicate the control chamber communication passage with the high-pressure passage and to block the exhaust passage from the second intermediate chamber. The actuator actuates the valve element in the direction to block the control chamber communication passage from the high-pressure passage and to communicate the exhaust passage with the second intermediate chamber. The valve element includes the high-pressure-side valve portion, the low-pressure-side valve portion, the releasing portion, and the valve element internal passage. The high-pressure-side valve portion is in an annular shape. The high-pressure-side valve portion is configured to make contact with the high-pressure seat surface formed in the body and to move away from the high-pressure seat surface. The high-pressure-side valve portion is configured to communicate the control chamber communication passage with the high-pressure passage and to block the control chamber communication passage from the high-pressure passage. The low-pressure-side valve portion is configured to make contact with the low-pressure seat surface formed in the body and to move away from the low-pressure seat surface. The low-pressure-side valve portion is configured to communicate the exhaust passage with the second intermediate chamber and to block the exhaust passage from the second intermediate chamber. The releasing portion is formed in the radially inside of the high-pressure-side valve portion. The releasing portion is in a communication state with the control chamber communication passage when the high-pressure seat surface is in contact with the high-pressure-side valve portion to block the control chamber communication passage from the high-pressure passage. The valve element internal passage is formed inside the valve element to communicate the releasing portion with the second intermediate chamber.

In the present configuration, when the valve element blocks the control chamber communication passage from the high-pressure passage, pressure in the control chamber, which is controlled at low pressure less than pressure of high-pressure fuel, is applied to the releasing portion of the valve element. Therefore, force, which is caused by pressure in the control chamber to bias the valve element, becomes small. Therefore, actuating force required to the actuator becomes small thereby to enable to downsize the actuator.

In addition, even in a case where the common rail pressure becomes higher than a present pressure, and/or even in a case where a passage area of a throttle of the high-pressure passage is further enlarged, the present configuration may avoid enlargement of the actuator.

The above processings such as calculations and determinations may be performed by any one or any combinations of software, an electric circuit, a mechanical device, and the like. The software may be stored in a storage medium, and may be transmitted via a transmission device such as a network device. The electric circuit may be an integrated circuit, and may be a discrete circuit such as a hardware logic configured with electric or electronic elements or the like. The elements producing the above processings may be discrete elements and may be partially or entirely integrated.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel injection valve comprising:

a body having a nozzle hole for injecting high-pressure fuel into a combustion chamber of an internal combustion engine;

a nozzle needle movable back and forth in the body to open and close the nozzle hole;

a control chamber configured to apply fuel pressure to the nozzle needle in a closing direction;

a first intermediate chamber communicated with the control chamber through a control chamber communication passage and configured to receive high-pressure fuel through a high-pressure passage;

a second intermediate chamber communicated with a low-pressure portion through an exhaust passage;

a valve cylinder configured to partition the first intermediate chamber from the second intermediate chamber;

a valve element movable in a cylinder hole, which is formed in the valve cylinder, to control communication between the control chamber communication passage and the high-pressure passage and to control communication between the exhaust passage and the second intermediate chamber;

a valve element spring biasing the valve element in a direction to communicate the control chamber communication passage with the high-pressure passage and to block the exhaust passage from the second intermediate chamber; and an actuator configured to actuate the valve element in a direction to block the control chamber communication passage from the high-pressure passage and to communicate the exhaust passage with the second intermediate chamber, wherein the valve element includes:

a high-pressure-side valve portion in an annular shape and configured to make contact with a high-pressure seat surface formed in the body and to move away from the high-pressure seat surface to control communication between the control chamber communication passage and the high-pressure passage;

a low-pressure-side valve portion configured to make contact with a low-pressure seat surface formed in the body and to move away from the low-pressure seat surface to control communication between the exhaust passage and the second intermediate chamber;

a releasing portion formed on a radially inside of the high-pressure-side valve portion and configured to communicate with the control chamber communication passage when the high-pressure seat surface is in contact with the high-pressure-side valve portion to block the control chamber communication passage from the high-pressure passage; and a valve element internal passage formed in the valve element and configured to communicate the releasing portion with the second intermediate chamber, wherein the releasing portion is blocked from the first intermediate chamber when the high-pressure seat surface is in contact with the high-pressure-side valve portion.

2. The fuel injection valve according to claim 1, wherein the valve element is divided into a first valve element and a second valve element, the first valve element has the high-pressure-side valve portion, and the second valve element has the low-pressure-side valve portion.

3. The fuel injection valve according to claim 1, wherein the first intermediate chamber and the second intermediate chamber are defined by the body and the valve cylinder, and the valve cylinder is biased from a cylinder spring onto the body to seal between the first intermediate chamber and the second intermediate chamber.

4. The fuel injection valve according to claim 1, wherein the first intermediate chamber and the second intermediate chamber are defined by the body and the valve cylinder, and the valve cylinder is biased with high-pressure fuel, which is in the first intermediate chamber, onto the body to seal between the first intermediate chamber and the second intermediate chamber.

5. The fuel injection valve according to claim 3, wherein the valve cylinder has a protrusion in an annular shape, and the protrusion is biased toward the body.

6. The fuel injection valve according to claim 1, wherein the high-pressure-side valve portion has a seat surface at which the high-pressure-side valve portion is in contact with the high-pressure seat surface when the high-pressure seat surface is in contact with the high-pressure-side valve portion, the releasing portion is located at an inside in the seat surface of the high-pressure-side valve portion in a radial direction, and the releasing portion is a space in a columnar shape and dented into the high-pressure-side valve portion in an axial direction.

7. The fuel injection valve according to claim 6, wherein the valve element internal passage extends from the releasing portion in the axial direction through the high-pressure-side valve portion at a center in the radial direction, and the valve element internal passage further extends inside the high-pressure-side valve portion outward in the radial direction, opens at a circumferential periphery of the high-pressure-side valve portion, and communicates with the second intermediate chamber.

8. The fuel injection valve according to claim 1, further comprising:

a nozzle cylinder accommodated in the body, wherein the nozzle needle has a rear end inserted in the nozzle cylinder, the rear end of the nozzle needle and the nozzle cylinder define a control chamber, and the control chamber is configured to apply a fuel pressure in the control chamber onto the nozzle needle to bias the nozzle needle in the closing direction.

* * * * *